United States Patent [19]

Sprando

[11] 4,021,631

[45] May 3, 1977

[54] ELECTRICAL HEADER DEVICE

[76] Inventor: Anthony Edward Sprando, 3115 NW. Cornell, Portland, Oreg. 97210

[22] Filed: Sept. 15, 1975

[21] Appl. No.: 613,341

Related U.S. Application Data

[63] Continuation-in-part of Ser. No. 414,919, Nov. 12, 1973, Pat. No. 3,906,416.

[52] U.S. Cl. ..... 200/238; 335/128; 339/198 R

[51] Int. Cl.[2] ..... H01H 1/00

[58] Field of Search ..... 200/237, 283, 246, 238, 200/244, 292, 284; 317/101 CM, 100, 101 A; 339/17 C, 112 R, 198 R, 198 C, 198 E, 198 G, 198 GA, 198 H, 198 J, 198 K, 198 P, 198 S, 198 M, 198 N, 217 R, 217 J, 217 S, 217 SP, 217 TP, 218 R, 218 M, 218 C; 174/16 HS; 336/192, 61; 335/124, 128

[56] References Cited

UNITED STATES PATENTS

| | | | |
|---|---|---|---|
| 2,415,404 | 2/1947 | Baller | 339/112 R |
| 2,852,639 | 9/1958 | Nelsen | 335/124 |
| 3,340,438 | 9/1967 | Dion et al. | 317/101 A |
| 3,590,327 | 6/1971 | Thomae | 317/100 |
| 3,906,416 | 9/1975 | Sprando | 335/128 |

*Primary Examiner*—Robert K. Schaefer
*Assistant Examiner*—Morris Ginsburg
*Attorney, Agent, or Firm*—Adrian J. LaRue

[57] ABSTRACT

An electrical header device is comprised of an etched circuit board or a ceramic substrate having circuit paths thereon to which are soldered terminal pins, and a thermoplastic or thermoset plastic material covers the etched circuit board or ceramic substrate leaving parts of the terminal pins extending outwardly from the plastic material for connection with an electric component and with electrical terminals in a mounting board.

3 Claims, 4 Drawing Figures

ELECTRICAL HEADER DEVICE

CROSS REFERENCE TO RELATED APPLICATION

This application is a continuation-in-part application of U.S. Pat. No. 3,906,416, issued Sept. 16, 1975 Application Ser. No. 414,919, filed Nov. 12, 1973, now

BACKGROUND OF THE INVENTION

Headers carrying electrical pins or sockets, the bodies which are made of plastic material, are known. The electrical pins or sockets in the plastic body are susceptible to movement when heat is applied to the pins or sockets when soldering an electrical component thereto. Such movement of the pins or sockets in the plastic body is caused by the heat of soldering. Movement of the pins or sockets in the plastic body results in misalignment of pins or sockets and they will not mate with respective sockets or pins or holes in a circuit borad to which the header is to be connected without realigning the pins or sockets. Movements of the pins, when the pins are to have electical contacts connected thereto, will result in improper operation of the contacts by relay or switch means. This involves additional time and expense, and, if the electrical component is to be provided in a heremetically-sealed environment, the heat of soldering the component to the pins or sockets may prevent proper sealing from being accomplished.

SUMMARY OF THE INVENTION

The present invention relates to electrical header devices and more particularly to header devices for electrical components and for connection with electrical circuitry on a circuit board or the like.

An object of the present invention is to provide an electrical header device which has electrical terminals that are resistant to movement.

Another object of the present ivnention is the provision of an electrical header device including a circuit board in which electrical terminals are secured.

A further object of the present invention is to provide an electrical header device having a ceramic substrate in which electrical terminals are secured.

An additional object of the present invention is the provision of an electrical header device having conductive pads on a circuit board or ceramic substrate to which electrical terminals are secured.

A still further object of the present invention is to provide an electrical header device having conductive pads on a circuit board or ceramic to which electrical pins are secured, the circuit board or ceramic substrate being encapsulated in a thermoplastic or thermoset material with parts of the terminals extending outwardly from top and bottom surfaces of the thermoplastic or thermoset material for soldered connection with an electrical component and for connection with terminal means in a circuit board.

Still an additional object of the present invention is the provision of heat sink means provided on circuit board or ceramic substrate means connected to electrical terminal means which is then encapsulated in thermoplastic or thermoset material to provide an electrical header means for connection with electrical component means and for connection with circuit means on circuit board means.

These and other objects of the invention will appear more fully from the following description and the accompanying preferred embodiment of the invention. It is to be understood that changes may be made from the exact details shown and described without departing from the principles of the invention.

DETAILED DESCRIPTION OF THE INVENTION

Figure 1:
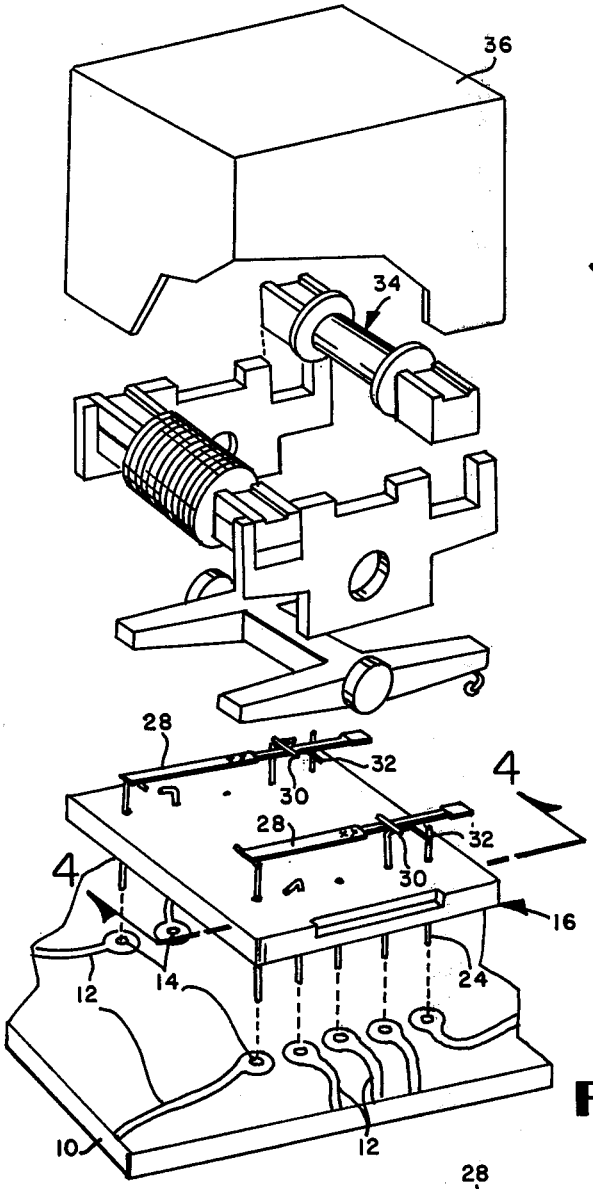
FIG. 1 is an exploded perspective view of an electrical header device, electrical relay and circuit board.
Figure 2:
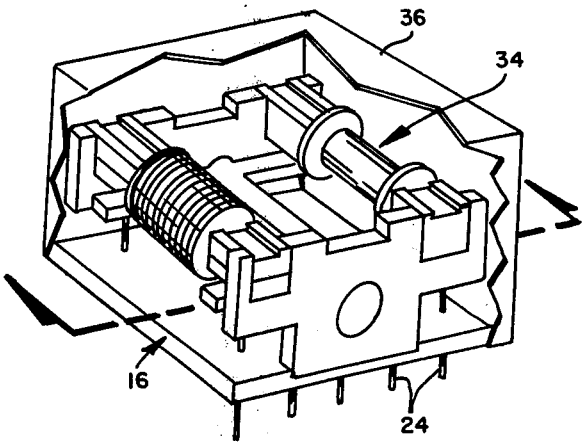
FIG. 2 is a perspective view of the electrical header device and relay in assembled condition.
Figure 3:
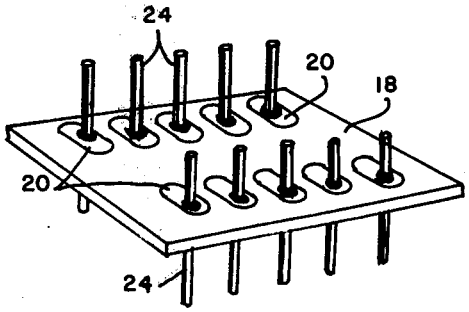
FIG. 3 is a perspective view of the pin carrying means of the electrical header device.
Figure 4:
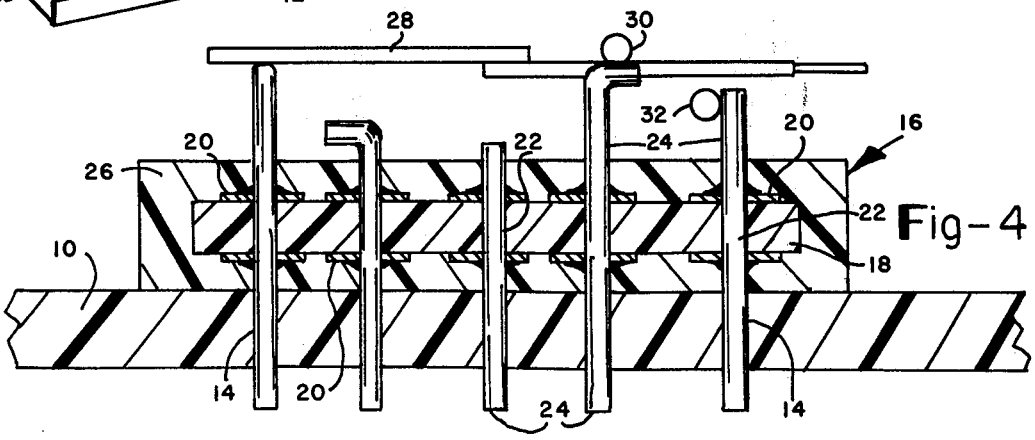
FIG. 4 is a section taken along lines 4—4 of FIG. 1.

A printed circuit board 10 is shown in FIGS. 1 and 4 which includes conductive paths 12 and holes 14 that may be plated through thereby electrically connecting paths 12 with conductive paths on the bottom surface of board 10. Electrical sockets or pins can be soldered in holes 14 if desired.

Electrical header device 16 comprises a pin-carrying member 18 that is made of a suitable conventional dielectric material used in making printed circuit boards or is a conventional ceramic substrate material. Metallic pads 20 are preferably provided on top and bottom surfaces of member 18 although only one surface may have pads 20 thereon. Pads 20 are formed on pin-carrying member 18 in accordance with conventional etching techniques utilized in printed circuit board and hybrid semiconductor manufacturing technologies. Holes 22 extend through pads 20 and member 18 and electrical terminal pins 24 are positioned in holes 22. Pins 24 are soldered to pads 20 by means of high temperature solder.

Member 18 with pins 24 soldered to pads 20 is positioned in a mold and a conventional thermoplastic or thermoset material is molded around member 18 to provide a covering 26 therefor with sections of pins 24 extending outwardly from covering 26. Covering 26 encapsulates member 18 except for the pins sections extending outwardly therefrom.

Pin-carrying member 18 with pads 20 and pins 24 soldered thereto provide mechanical strength to pins 24, and, when electrical contacts 28, 30 and 32 are spot welded to pins 24, the heat is dissipated by pins 24 and pads 20 with pads 20 defining heat sinks thereby rendering the pins temperature resistant. The same situation occurs when pins 24 are soldered to conductive paths on board 10 as shown in FIG. 4.

An electrical relay assembly 34 as disclosed in Ser. No. 414,919, now U.S. Pat. No. 3,906,416 is secured on header device 16 for operating contacts 28,30 and 32. Other kinds of electrical components or electronic components can be mounted on header device 16 as desired. A thermoplastic cap 36 is heat welded to header device 16 to provide a hermetically-sealed assembly in the manner of the relay disclosed in Ser. No. 414,919, now U.S. Pat. No. 3,906,416

The fact that pins 24 have excellent mechanical strength and are heat resistant, enables pins 24 to not move and therefore provides pins that are in proper alignment for dispositon in holes 14 and contacts 28,30 and 32 will remain in proper position for operation by relay 34. The hermetic seal is easily realized due to lack of movement of pins 24.

As can be discerned, only certain ones of the internal sections of pins 24 are used in conjunction with contacts 28,30 and 32 so that the nonused pins can be cut off at the surface of covering 26 or bent over so as to be out of the way. If desired, all pins 24 can of course be used depending upon the condition. It is desirable that the external sections of pins 24 be solered to respective conductive paths on board 10.

Pads 20 can provide necessary conductive paths to mount electronic components such as diodes, transistors integrated circuits, resistors, capacitors and the like thereon. Pads 20 can interconnect pins 24 to provide connection between contacts of an electrical component which reduces inductance and/or capacitance and reduces connective lead lengths which positons the connections between circuit board conductive paths and contacts of electrical component closer together for high frequency applications.

It can readily be appreciated that a unique electrical header device has been disclosed which has been disclosed which has a terminal-carrying means that enables terminal means to be secured therein with excellent mechanical strength and head resistant capability to prevent movement of the terminal means. Although the invention has been explained with references to a particular embodiment, it is to be appreciated that various adaptations and modifications may be made without departing from the appended claims.

The invention is claimed in accordance with the following:

1. An electrical header device for electrical connection with electrical components or switching means comprising:

a dielectric member of planar configuration having conductive means secured on at least one surface of said dielectric member at spaced intervals;

electrical pin means extending through each of said conductive means and said dielectric member and being connected to said conductive means by high temperature solder means thereby securing said electrical pin means in position in said dielectric member with excellent mechanical strength and heat resistant capability to maintain said electrical pin means in position, each of said electrical pin means having a section extending outwardly from one surface of said dielectric member for electrical connection to electrical components or switching means and another section extending outwardly from another surface of said dielectric member for connection with conductor means on a printed circuit board means; and insulating means encapsulating said dielectric member with said sections of said electrical pin means extending outwardly from said insulating means.

2. A header device according to claim 1 wherein said conductive means are provided on upper and lower surfaces of said dielectric member which are connected to said electrical pin means by said high temperature solder means.

3.A header device according to claim 1 wherein said conductive means define heat sink means.

* * * * *